US009335113B1

(12) United States Patent
Chen

(10) Patent No.: US 9,335,113 B1
(45) Date of Patent: May 10, 2016

(54) QUICK AND STABLE CLAW ATTACHMENT ASSEMBLY SYSTEMS FOR FIREARM AND FIREARM STANDS

(71) Applicant: Xiao Ming Chen, Charlottetown (CA)

(72) Inventor: Xiao Ming Chen, Charlottetown (CA)

(73) Assignee: PELETON TECHNOLOGY LLC, Boulder, CO (US)

( * ) Notice: Subject to any disclaimer, the term of this patent is extended or adjusted under 35 U.S.C. 154(b) by 0 days.

(21) Appl. No.: 14/660,608

(22) Filed: Mar. 17, 2015

Related U.S. Application Data

(60) Provisional application No. 61/954,315, filed on Mar. 17, 2014.

(51) Int. Cl.
*F41A 23/02* (2006.01)
*F41A 35/00* (2006.01)

(52) U.S. Cl.
CPC ..... *F41A 35/00* (2013.01); *F41A 23/02* (2013.01)

(58) Field of Classification Search
CPC ..... F41A 23/00; F41A 23/02; F41A 23/04; F41A 23/08; F41A 23/10; F41A 23/12; F41A 23/14; F41A 23/16; F41A 23/18; F41A 35/00
USPC ..... 42/94, 90; 89/37.04
See application file for complete search history.

(56) References Cited

U.S. PATENT DOCUMENTS 3,235,997 A * 2/1966 Stoner ..... F41A 23/08 42/94
4,397,112 A * 8/1983 York ..... F41A 23/08 42/94
5,194,678 A * 3/1993 Kramer ..... F16M 11/16 42/94
6,289,622 B1 * 9/2001 Desch, Jr. ..... F41A 23/10 42/94
6,763,627 B1 * 7/2004 Kaempe ..... F41A 23/10 42/94
8,291,633 B1 * 10/2012 Hass ..... F41A 23/10 42/72
2006/0278797 A1 * 12/2006 Keng ..... F16M 11/36 248/440.1
2009/0000175 A1 * 1/2009 Potterfield ..... F41A 23/10 42/94
2009/0064559 A1 * 3/2009 Potterfield ..... F41G 11/004 42/94
2009/0126250 A1 * 5/2009 Keng ..... F41A 23/10 42/94
2010/0307046 A1 * 12/2010 Cheng ..... F41C 27/22 42/94
2014/0190059 A1 * 7/2014 Ballard ..... F41C 23/16 42/94

* cited by examiner

*Primary Examiner* — Joshua Freeman

(57) ABSTRACT

A claw mounting system for a firearm stand engages with a sling stud of a firearm so that the firearm can be securely attached with the firearm stand. The claw mounting system includes an elastically loaded claw assembly, a securing member, and a bracket member as the securing member is threadly engaged with a sleeve portion of the bracket member while a left claw member and a right claw member of the elastically loaded claw assembly are tensionaly connected to each other through a spring-tension unit. The left claw member and the right claw member are also hingedly connected to a first tab of the bracket member through a retainer channel and a retainer pin. The claw mounting system greatly reduces the mounting process time of a firearm by remaining in a stable vertical position during attachment and detachment of a firearm stand.

11 Claims, 8 Drawing Sheets

QUICK AND STABLE CLAW ATTACHMENT ASSEMBLY SYSTEMS FOR FIREARM AND FIREARM STANDS

The current application claims a priority to the U.S. Provisional Patent application Ser. No. 61/954,315 filed on Mar. 17, 2014.

FIELD OF THE INVENTION

The present invention relates generally to firearms and firearm attachment systems. More specifically, the present invention is a claw mounting system for firearm stands such as monopods, bipods, and tripods that greatly reduces the mounting process time by remaining in a stable vertical position during attachment and detachment of a firearm stand.

BACKGROUND OF THE INVENTION

When operating a firearm, it is common for the operator to mount a firearm stand such as a bipod, monopod, or tripod to the firearm. A firearm stand offers several advantages to the operator, most importantly a greatly increased level of stability during shooting. Monopods feature a single leg and are often used with smaller firearms and offer the advantage of being lightweight and compact, although monopods often do not provide adequate stability for use with large firearms. Bipods feature two legs and allow an operator to rest the firearm on the ground, the top of a low wall, or similar surface during shooting. Bipods are often used with larger firearms such as rifles and machine guns in order to increase accuracy as well as reduce operator fatigue as bipods eliminate the need for the operator to physically hold and steady the firearm. Tripods feature three legs and similar to bipods, allow the operator to rest the firearm on a surface during shooting. Tripods are often heavy and bulky although tripods offer an additional level of stability when compared to bipods. As such, tripods are commonly used on large firearms such as rifles and machine guns. Firearm stands are often mounted to firearms via a mechanism that allows convenient attachment and detachment as well as convenient deployment as needed. Common attachment mechanisms include the Picatinny rail and claw systems that are designed to clamp to a firearm sling stud. While Picatinny rails are modular and relatively straightforward to use, the rails are often not present or are unsuitable for use with firearm stands and various firearms such as hunting rifles. Claw systems are designed for use with such firearms that require the operator to insert the claw system through a hole present in the forend pad of the firearm stand in order to access the sling stud to which the claw system may be clamped. The claw system is generally attached in order to complete the mounting of the firearm stand. The operator is required to adjust and orient the claw system beneath the forend pad to a proper angle in order to bypass the hole. This process is cumbersome and time-consuming as it is common for the claw system to fall through the hole in the forend pad after the claw system has been removed. The present invention seeks to address the aforementioned issues relating to firearm stand mounting mechanisms as well as provide a straightforward and convenient solution.

The present invention is a claw mounting system for facilitating the process of attaching and detaching a firearm stand such as a monopod, bipod, or tripod to a firearm. In the preferred embodiment of the present invention, the claw mounting system comprises a claw assembly that is designed to be inserted and secured against the wall of the hole of a firearm stand. The claw mounting system may be secured to a sling attachment point as well. The claw assembly comprises an elastic element and pin that assists in retaining the claw mounting system in the proper vertical position by allowing the operator to adjust the tension of the claw assembly. The object of the present invention is to maintain the claw mounting system for a firearm stand in the vertical position once inserted into the forend pad of the firearm stand. This prevents the claw mounting system from falling through the hole of the forend pad as the tension of the claw mounting system may be increased to hold the claw mounting system in place when the firearm stand is detached from the firearm.

DETAIL DESCRIPTIONS OF THE INVENTION

All illustrations of the drawings are for the purpose of describing selected versions of the present invention and are not intended to limit the scope of the present invention.

Figure 1:
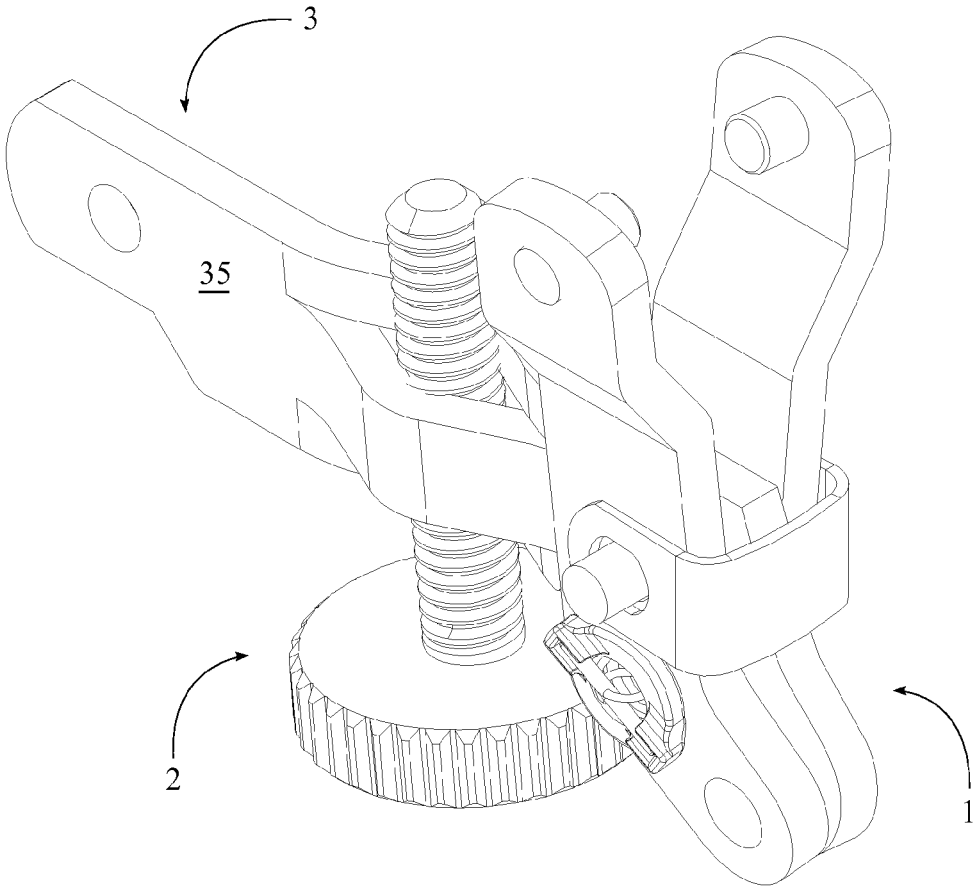
FIG. 1 is a perspective view of the present invention.

The present invention is a claw attachment assembly system that facilitates the process of attaching and detaching a firearm stand to a firearm by maintaining the claw attachment assembly system in the proper vertical position. The present invention is designed to be used in conjunction with firearm stands such as monopods, bipods, and tripods. The component configuration of the present invention not only securely attaches the firearm to the firearm stand but also prevents the present invention from falling through a hole of the forend pad of the firearm stand when the firearm is detached. In reference to FIG. 1, the present invention comprises an elastically loaded claw assembly 1, a securing member 2, and a bracket member 3. As for the general configuration of the present invention, the securing member 2 is threadly engaged with the bracket member 3 while the elastically loaded claw assembly 1 is hingedly connected with the bracket member 3.

The bracket member 3 functions as the interconnecting member between the elastically loaded claw assembly 1 and the forend pad of the firearm stand; however the bracket member 3 may or may not connect to the forend pad of the firearm stand. In reference to FIG. 7-8, the bracket member 3 comprises a sleeve portion 31, a first tab 32, and a second tab 33. The first tab 32 and the second tab 33 are laterally connected to the sleeve portion 31 in such a way that the first tab 32 and the second tab 33 are diametrically opposed of each other across the length of the bracket member 3. The sleeve portion 31 is formed to receive the securing member 2 so that the securing member 2 can be threadly engaged with the sleeve portion 31 for the proper functionality of the present invention. The shape of the bracket member 3 is delineated within the present invention as long as the bracket member 3 is able to accept the securing member 2 and the elastically loaded claw assembly 1 while the bracket member 3 is able to position with the forend pad of the firearm stand.

Figure 7:
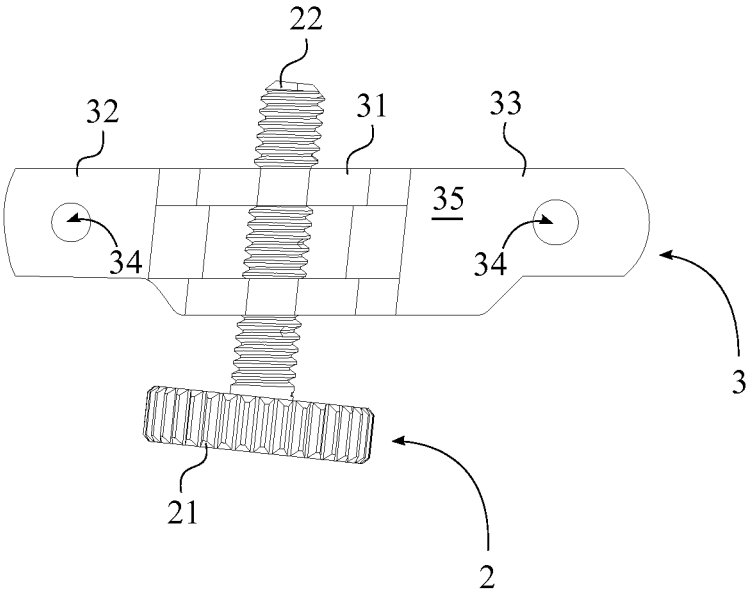
FIG. 7 is a side view of the bracket member and the securing member of the present invention.
Figure 8:
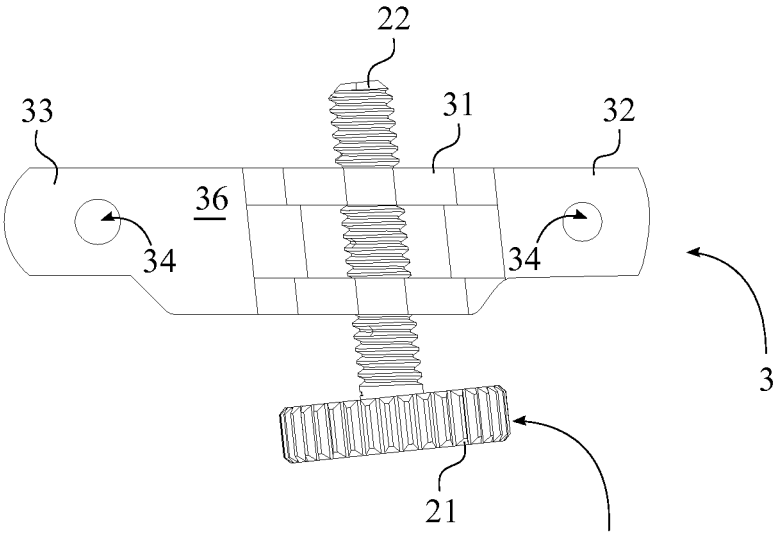
FIG. 8 is another side view of the bracket member and the securing member of the present invention.

In reference to FIG. 7-8, the first tab 32 and the second tab 33 each comprise an opening 34 so that the bracket member 3 is able to connect with the forend pad of the firearm stand and the elastically loaded claw assembly 1. The opening 34 for the first tab 32 is traversed from a first surface 35 of the bracket member 3 to a second surface 36 of the bracket member 3. Similarly, the opening 34 for the second tab 33 is also traversed from the first surface 35 of the bracket member 3 to the second surface 36 of the bracket member 3. The opening 34 of the second tab 33 can be utilized to secure the bracket member 3 to the forend pad of the firearm stand with a split ring connecter or any other types of similar fasteners. More specifically, the opening 34 of the second tab 33 is externally positioned with the forend pad of the firearm stand through a cavity of the forend pad of the firearm stand while the rest of the bracket member 3 is positioned underneath the forend pad of the firearm stand. Then the split ring connecter is engaged with the opening 34 of the second tab 33 so that the split ring connecter is able to connect the bracket member 3 to the forend pad of the firearm stand. The opening 34 of the first tab 32 is utilized within the present invention to secure the elastically loaded claw assembly 1 as the elastically loaded claw assembly 1 is hingedly connected with the first tab 32 of the bracket member 3. Additionally, the elastically loaded claw assembly 1 is perpendicularly positioned with the forend pad of the firearm stand and retained within the hole of the forend pad of the firearm.

Figure 2:
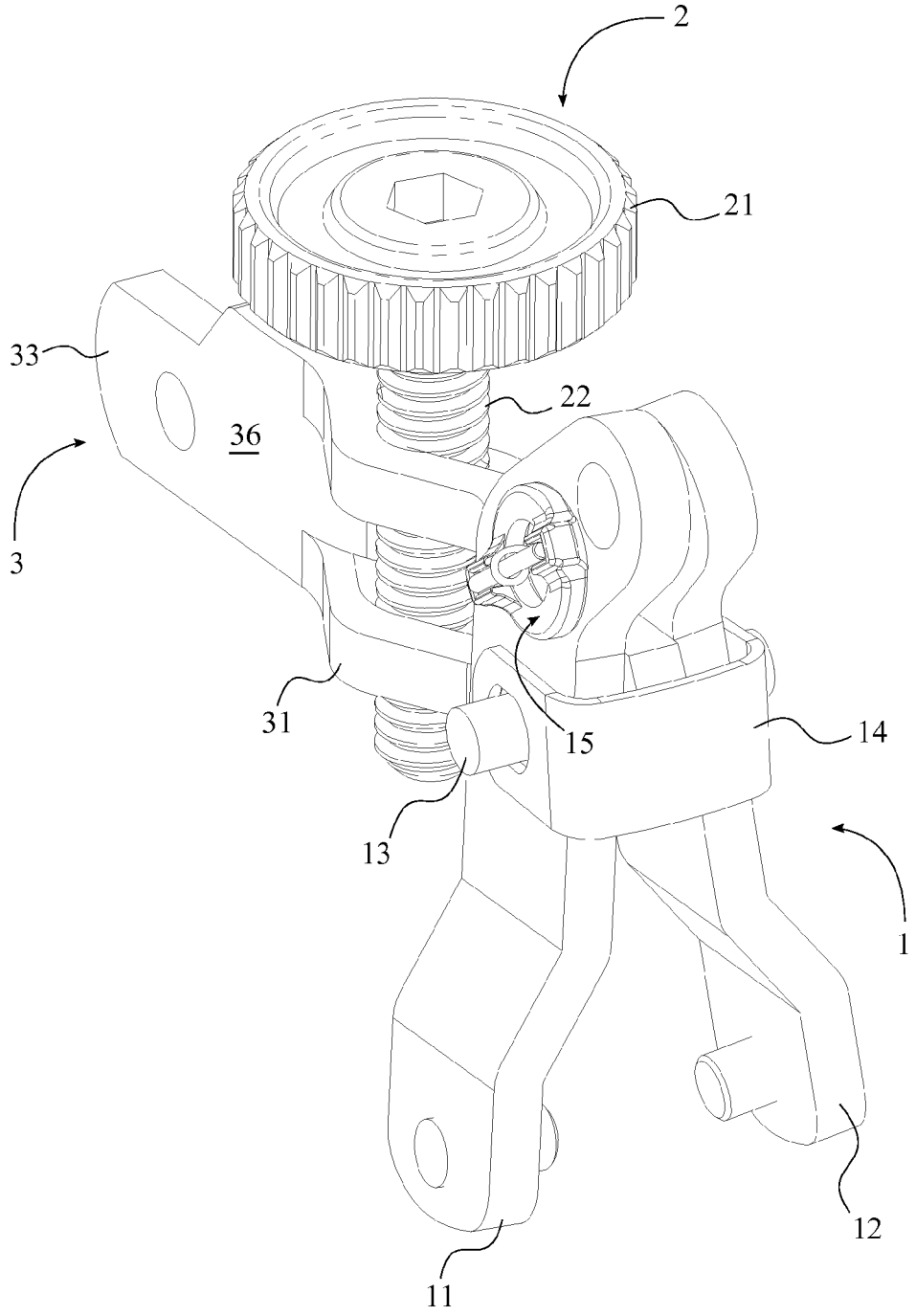
FIG. 2 is a bottom perspective view of the present invention.
Figure 3:
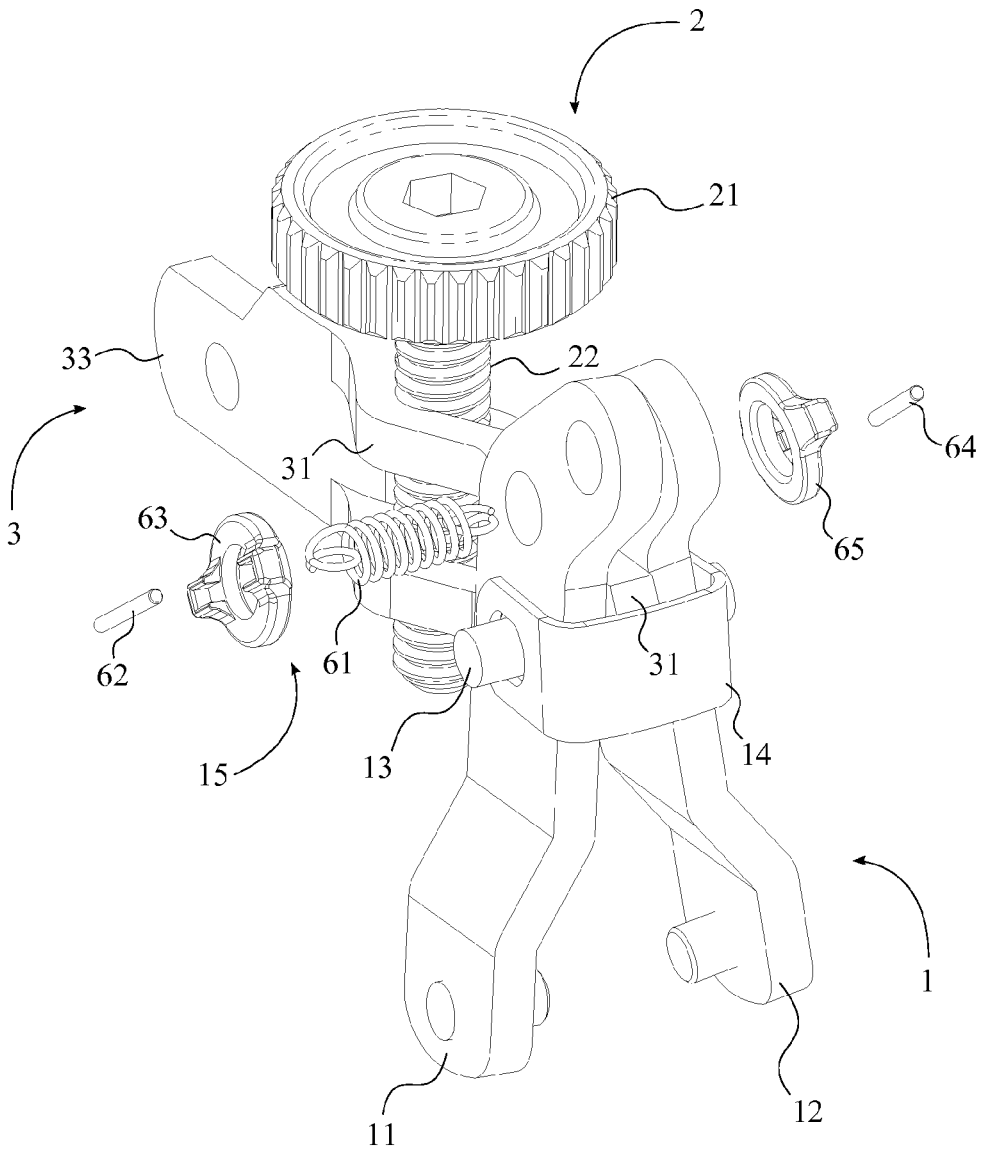
FIG. 3 is an exploded view of the present invention, wherein the spring-tension unit is exploded from the rest of the components.

The elastically loaded claw assembly 1, which remains within the forend pad of the firearm stand when inserted, connects the present invention with a sling stud of the firearm so that the firearm stand can be secured to the firearm. In reference to FIG. 2-4, the elastically loaded claw assembly 1 comprises a left claw member 11, a right claw member 12, a retainer pin 13, a retainer channel 14, and a spring-tension unit 15. The left claw member 11 and the right claw member 12 are tensionaly connected to each other through the spring-tension unit 15 while the left claw member 11 and the right claw member 12 are hingedly connected to the first tab 32 through the retainer channel 14 and the retainer pin 13.

The left claw member 11 and the right claw member 12 function as the securing members of the present invention as the left claw member 11 and the right claw member 12 grab on to the sling stud of the firearm. In reference to FIG. 2-6 and FIG. 9-10, the left claw member 11 and the right claw member 12 each comprise an exterior face 41, an interior face 42, a securing section 43, a clamp section 44, a first opening 45, a second opening 46, a third opening 47, and a securing protrusion 48. The securing section 43 and the clamp section 44 are adjacently positioned with each other as the securing section 43 and the clamp section 44 divide the left claw member 11 and right claw member 12 into two different portions. The exterior face 41 and the interior face 42 are extended along the securing section 43 and the clamp section 44 and oppositely positioned of each other.

Figure 4:
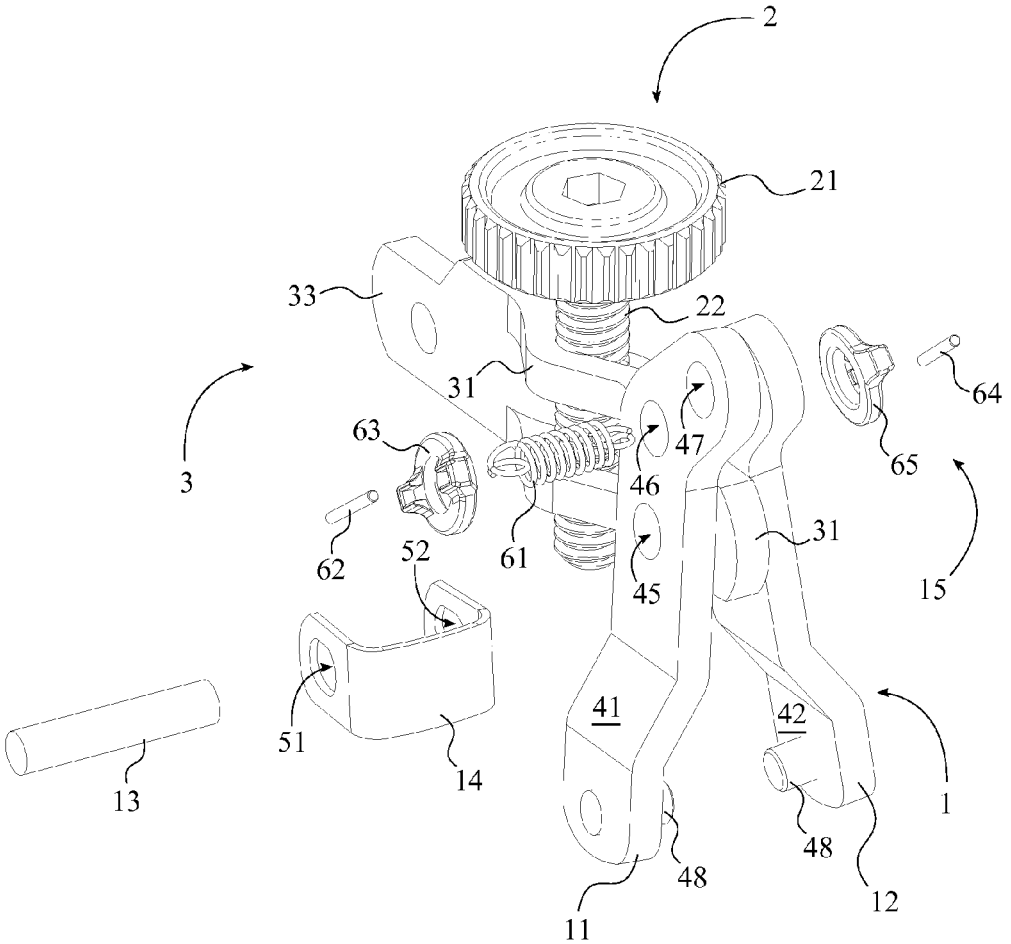
FIG. 4 is an exploded view of the present invention, wherein the spring-tension unit, the retainer channel, and the retainer pin are exploded from the rest of the components of the present invention.
Figure 5:
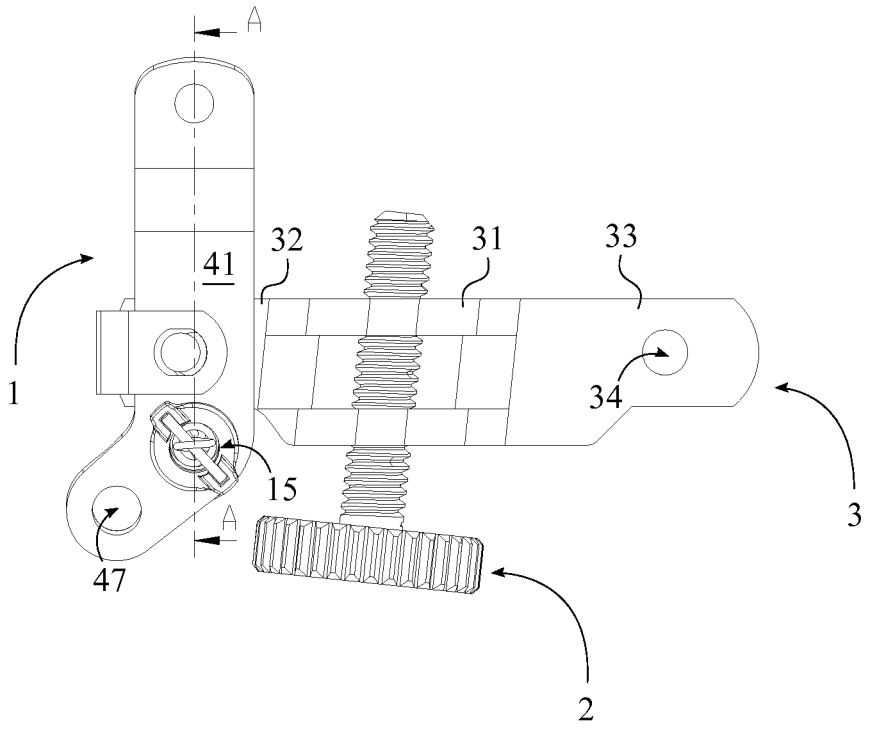
FIG. 5 is a side view of the present invention, showing the plane upon which a cross sectional view is taken shown in FIG. 6.
Figure 6:
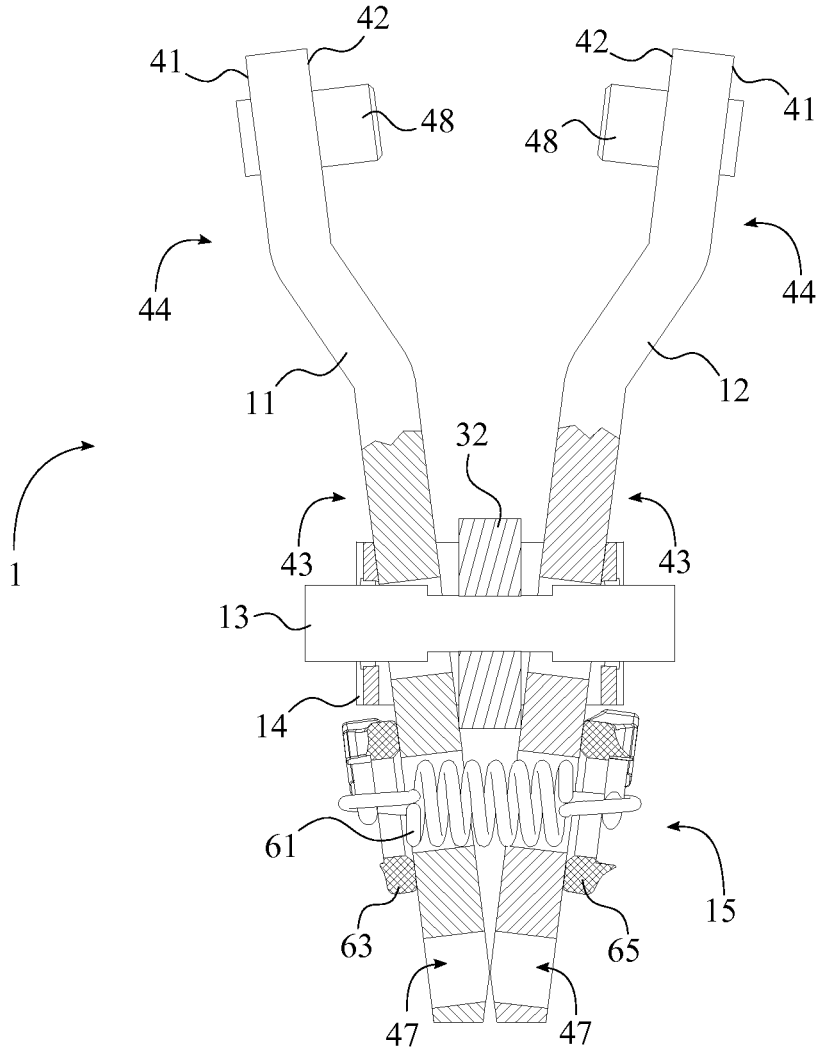
FIG. 6 is a cross section view thereof taken along line A-A of FIG. 5.
Figure 10:
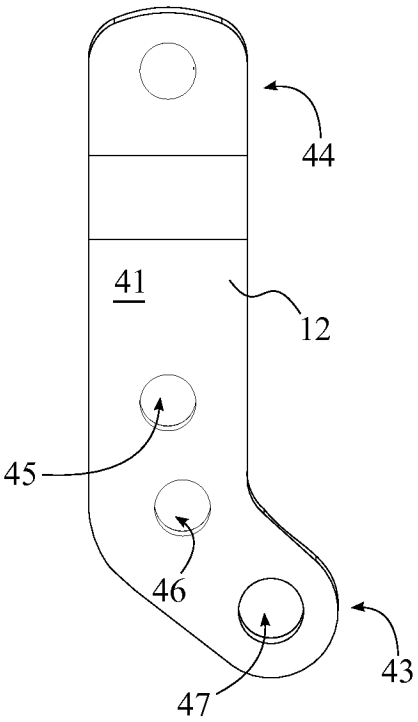
FIG. 10 is an exterior side view of the right clamp member of the present invention.
Figure 9:
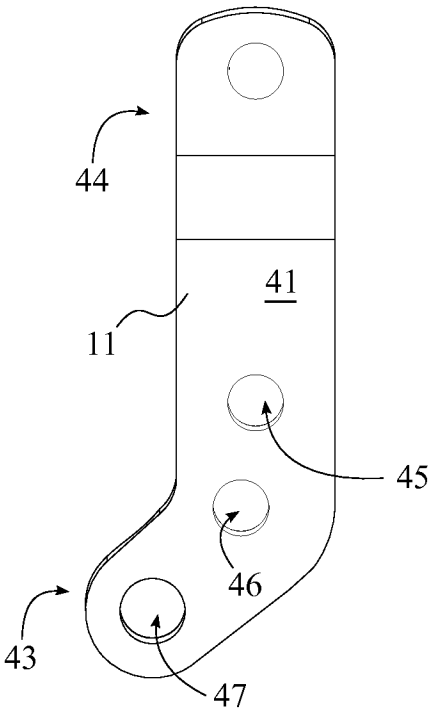
FIG. 9 is an exterior side view of the left clamp member of the present invention.

In reference to FIG. 4, FIG. 9, and FIG. 10, the first opening 45 that accepts with the retainer pin 13 is traversed through the securing section 43 and adjacently positioned with the clamp section 44. More specifically, the left claw member 11 and the right claw member 12 are positioned within the retainer channel 14 while the interior faces 42 of the left claw member 11 and the right claw member 12 are adjacently positioned with the first tab 32. As for the retainer channel 14, a first lateral wall opening 51 of the retainer channel 14 is adjacently positioned with the exterior face 41 of the left claw member 11 while a second lateral wall opening 52 of the retainer channel 14 is adjacently positioned with the exterior face 41 of the right claw member 12. Then the retainer pin 13 is traversed through the first lateral wall opening 51, the first opening 45 of the left claw member 11, the opening 34 of the first tab 32, the first opening 45 of the right claw member 12, and the second lateral wall opening 52. As a result, the left claw member 11 and the right claw member 12 can be hingedly secured to the first tab 32 of the bracket member 3 through the retainer channel 14 and the retainer pin 13.

In reference to FIG. 4, FIG. 9, and FIG. 10, the second opening 46 of the present invention allows the spring-tension unit 15 to be connected with the left claw member 11 and the right claw member 12 so that the clamp sections 44 of the left claw member 11 and the right claw member 12 can maintain an opened configuration before the present invention is engaged with the sling stud. The second opening 46 is traversed through the securing section 43 as the second opening 46 is positioned adjacent with the first opening 45 and opposite of the clamp section 44. The spring-tension unit 15 comprises an extension spring 61, a left pin 62, a left stop washer 63, a right pin 64, and a right stop washer 65 as the spring-tension unit 15 pulls the securing sections 43 of the left claw member 11 and the right claw member 12 together. The extension spring 61 is centrally positioned within the second openings 46 of the left claw member 11 and the right claw member 12 so that the left stop washer 63 and the left pin 62 are able to connect the extension spring 61 to the left claw member 11 while the right stop washer 65 and the right pin 64 are able to connect the extension spring 61 to the right claw member 12, opposite of the left stop washer 63 and the left pin 62. More specifically, a left-spring-attachment end of the extension spring 61 is traversed through the left stop washer 63 so that the left pin 62 is able to traverse through the left stop washer 63 and the left-spring-attachment end, securing the left-spring-attachment end to the left claw member 11. Similarly, a right-spring-attachment end of the extension spring 61 is traversed through the right stop washer 65 so that the right pin 64 is able to traverse through the right stop washer 65 and the right-spring-attachment end, securing the right-spring-attachment end to the right claw member 12. In the preferred embodiment of the present invention, the extension spring 61 may be manipulated in order to adjust the tension between the left claw member 11 and the right claw member 12. Even though the preferred embodiment utilizes the extension spring 61 within the spring-tension unit 15, the present invention can also utilize any other type of elastic members within the spring-tension unit 15 as long as the utilized elastic member is able to pull together the left claw member 11 and the right claw member 12.

In reference to FIG. 4, FIG. 9, and FIG. 10, the third opening 47 is traversed through the securing section 43 as the third opening 47 is positioned adjacent with the second opening 46 and opposite of the first opening 45. Since the sling strap has to be removed from the sling stud in order to attach the present invention to the firearm, the third opening 47 provides a platform so that the sling strap can be secured back into the firearm. Even though the preferred embodiment of the present invention includes the third opening 47, the present invention can also be manufactured without the third opening 47 to accommodate for firearms that do not have a sling strap.

The securing protrusion 48, which engages with the sling stud, is perpendicularly connected with the interior face 42 of the clamp section 44. Since the securing member 2 is not engaged with the forend pad of the firearm stand, the left claw member 11 and the right claw member 12 are able to maintain the opened configuration enabling the sling stud to be engaged with the securing protrusions 48 of the left claw member 11 and the right claw member 12. In other words, the spring-tension unit 15 maintains the tension between securing sections 43 of the left claw member 11 and the right claw member 12 so that the clamp sections 44 of the left claw member 11 and the right claw member 12 can be opened to the sling stud. Once the securing protrusions 48 of the left claw member 11 and the right claw member 12 are engaged with the sling stud, the securing member 2 allows the users to adjust the tension between the present invention and the firearm stand by manually manipulating the securing member 2.

Even though the present invention utilizes a tension screw as the preferred securing member 2, the present invention can utilize any other type of securing means including, but not limited to, a tension pin, an adjustable clamping mechanism, a latching mechanism. In reference to FIG. 5, a threaded screw body 22 of the securing member 2 is engaged with the sleeve portion 31 in such way that a screw head 21 of the securing member 2 is adjacently positioned with the second openings 46 of the left claw member 11 and the right claw member 12. As a result, the securing member 2 is positioned within the bracket member 3 in a manner such that the screw head 21 can be easily accessed by the users. The securing member 2 indirectly engages with the extension spring 61 as the securing member 2 determines the position of the bracket member 3 with respect to the forend of the firearm stand. When the securing member 2 is driven into the bracket member 3, the securing member 2 simultaneously engages with the forend pad of the firearm stand and pushes the bracket member 3 in downward direction. Then the downward direction of the bracket member 3 pulls the elastically loaded claw assembly 1 downward through the forend pad of the firearm stand. As a result, the securing protrusions 48 of the left claw member 11 and the right claw member 12 are engaged with the sling stud and able to pull the down the firearm toward the forend pad of the firearm stand as the securing protrusions 48 of left claw member 11 and the right claw member 12 come together. When the firearm needs to be released from the forend pad of the firearm stand, the securing member 2 is utilized to relax the extension spring 61 so that the securing protrusions 48 of the left claw member 11 and the right claw member 12 can be released so that the securing protrusions 48 of left claw member 11 and the right claw member 12 can be disengaged from the sling stud.

Since the present invention is maintained in a stable vertical position within the forend pad of the firearm stand, the elastically loaded claw assembly 1 is unable to fall through the forend pad of the firearm stand when the firearm is detached. This is due to the fact that the tension of the spring-tension unit 15 is able to hold the elastically loaded claw assembly 1 in the proper vertical position when the firearm stand is detached from the firearm. The object of the present invention is to eliminate the ability for the elastically loaded claw assembly 1 to become dislodged and fall out of position within the firearm stand when the firearm stand is removed from the firearm. Conventional claw mounting systems feature designs that require an operator to reinsert the claw mounting system into the forend pad of the firearm stand each time the firearm stand is attached to the firearm. This process can be both cumbersome and time-consuming as the process must be repeated each time the operator wishes to attach the firearm stand to the firearm. The elastically loaded claw assembly 1 of the present invention eliminates the need to reinsert the elastically loaded claw assembly 1 due to the fact that the present invention remains in place within the forend pad of the firearm stand when the firearm stand is removed from the firearm. As such, the present invention is able to greatly facilitate the process of attaching the firearm stand to the firearm.

Although the invention has been explained in relation to its preferred embodiment, it is to be understood that many other possible modifications and variations can be made without departing from the spirit and scope of the invention as hereinafter claimed.

What is claimed is:

1. A quick and stable claw attachment assembly system for firearm and firearm stand comprises:

an elastically loaded claw assembly;

a securing member;

a bracket member;

the elastically loaded claw assembly comprises a left claw member, a right claw member, a retainer pin, a retainer channel, and a spring-tension unit;

the bracket member comprises a sleeve portion, a first tab, and a second tab;

the securing member being threadly engaged with the sleeve portion;

the left claw member and the right claw member being tensionaly connected to each other through the spring-tension unit;

the left claw member and the right claw member being hingedly connected to the first tab through the retainer channel and the retainer pin;

the left claw member and the right claw member being positioned within the retainer channel;

an interior face of left claw member and the right claw member being adjacently positioned with the first tab;

an exterior face of the left claw member being adjacently positioned with a first lateral wall opening of the retainer channel;

an exterior face of the right claw member being adjacently positioned with a second lateral wall opening of the retainer channel;

the retainer pin traversing through the first lateral wall opening, a first opening of the left claw member, an opening of the first tab, a first opening of the right claw member, and the second lateral wall opening;

the spring-tension unit being connected with a second opening of the left claw member and a second opening of the right claw member;

the spring-tension unit comprises an extension spring, a left pin, a left stop washer, a right pin, and a right stop washer;

the extension spring being centrally positioned within the second opening of the left claw member and the right claw member;

the extension spring being adjacently connected to the left claw member by the left stop washer and the left pin; and the extension spring being adjacently the right claw member by the right stop washer and the right pin, opposite of the left stop washer and the left pin.

2. The quick and stable claw attachment assembly system for firearm and firearm stand as claimed in claim 1 comprises:

the first tab being laterally connected to the sleeve portion;

the second tab being laterally connected to the sleeve portion; and the first tab and the second tab being diametrically opposed of each other across the sleeve portion.

3. The quick and stable claw attachment assembly system for firearm and firearm stand as claimed in claim 1 comprises:

the first tab and the second tab each comprise an opening;

the opening of the first tab traversing from a first surface of the bracket member to a second surface of the bracket member; and the opening of the second tab traversing from the first surface of the bracket member to the second surface of the bracket member.

4. The quick and stable claw attachment assembly system for firearm and firearm stand as claimed in claim 1 comprises:

the left claw member and the right claw member each comprise an exterior face, an interior face, a securing section, a clamp section, a first opening, a second opening, and a securing protrusion;

the securing section and the clamp section being adjacently positioned with each other;

the exterior face and the interior face being extended along the securing section and the clamp section, opposite of each other;

the first opening traversing through the securing section the first opening being adjacently positioned with the clamp section;

the second opening traversing through the securing section;

the second opening being adjacently positioned with the first opening, opposite of the clamp section; and the securing protrusion being perpendicularly connected with the interior face of the clamp section.

5. The quick and stable claw attachment assembly system for firearm and firearm stand as claimed in claim 4 comprises:

the left claw member and the right claw member each further comprise a third opening;

the third opening traversing through the securing section; and the third opening being adjacently positioned with the second opening, opposite of the first opening.

6. The quick and stable claw attachment assembly system for firearm and firearm stand as claimed in claim 1 comprises:

a threaded screw body of the securing member being engaged with the sleeve portion; and a screw head of the securing member being adjacently positioned with a second opening of the left claw member and the right claw member.

7. A quick and stable claw attachment assembly system for firearm and firearm stand comprises:

an elastically loaded claw assembly;

a securing member;

a bracket member;

the elastically loaded claw assembly comprises a left claw member, a right claw member, a retainer pin, a retainer channel, and a spring-tension unit;

the bracket member comprises a sleeve portion, a first tab, and a second tab;

the first tab being laterally connected to the sleeve portion;

the second tab being laterally connected to the sleeve portion;

the first tab and the second tab being diametrically opposed of each other across the sleeve portion;

the securing member being threadly engaged with the sleeve portion;

the left claw member and the right claw member being tensionaly connected to each other through the spring-tension unit;

the left claw member and the right claw member being hingedly connected to the first tab through the retainer channel and the retainer pin;

the left claw member and the right claw member being positioned within the retainer channel;

an interior face of left claw member and the right claw member being adjacently positioned with the first tab;

an exterior face of the left claw member being adjacently positioned with a first lateral wall opening of the retainer channel;

an exterior face of the right claw member being adjacently positioned with a second lateral wall opening of the retainer channel;

the retainer pin traversing through the first lateral wall opening, a first opening of the left claw member, an opening of the first tab, a first opening of the right claw member, and the second lateral wall opening;

the spring-tension unit being connected with a second opening of the left claw member and a second opening of the right claw member;

the spring-tension unit comprises an extension spring, a left pin, a left stop washer, a right pin, and a right stop washer;

the extension spring being centrally positioned within the second opening of the left claw member and the right claw member;

the extension spring being adjacently connected to the left claw member by the left stop washer and the left pin; and the extension spring being adjacently the right claw member by the right stop washer and the right pin, opposite of the left stop washer and the left pin.

8. The quick and stable claw attachment assembly system for firearm and firearm stand as claimed in claim 7 comprises:

the first tab and the second tab each comprise an opening;

the opening of the first tab traversing from a first surface of the bracket member to a second surface of the bracket member; and the opening of the second tab traversing from the first surface of the bracket member to the second surface of the bracket member.

9. The quick and stable claw attachment assembly system for firearm and firearm stand as claimed in claim 7 comprises:

the left claw member and the right claw member each comprise an exterior face, an interior face, a securing section, a clamp section, a first opening, a second opening, and a securing protrusion;

the securing section and the clamp section being adjacently positioned with each other;

the exterior face and the interior face being extended along the securing section and the clamp section, opposite of each other;

the first opening traversing through the securing section the first opening being adjacently positioned with the clamp section;

the second opening traversing through the securing section;

the second opening being adjacently positioned with the first opening, opposite of the clamp section; and the securing protrusion being perpendicularly connected with the interior face of the clamp section.

10. The quick and stable claw attachment assembly system for firearm and firearm stand as claimed in claim 9 comprises:

the left claw member and the right claw member each further comprise a third opening;

the third opening traversing through the securing section; and the third opening being adjacently positioned with the second opening, opposite of the first opening.

11. The quick and stable claw attachment assembly system for firearm and firearm stand as claimed in claim 7 comprises:

a threaded screw body of the securing member being engaged with the sleeve portion; and a screw head of the securing member being adjacently positioned with a second opening of the left claw member and the right claw member.

* * * * *